United States Patent [19]

Sedlmayr

[11] 4,294,458

[45] Oct. 13, 1981

[54] SKI STOP

[75] Inventor: Gerhard Sedlmayr, Farchant, Fed. Rep. of Germany

[73] Assignee: Hannes Marker, Garmisch-Partenkirchen, Fed. Rep. of Germany

[21] Appl. No.: 961,458

[22] Filed: Nov. 16, 1978

[30] Foreign Application Priority Data

Nov. 18, 1977 [DE] Fed. Rep. of Germany ..... 2751602

[51] Int. Cl.[3] ..... A63C 7/10

[52] U.S. Cl. ..... 280/605

[58] Field of Search ..... 280/605

[56] References Cited

U.S. PATENT DOCUMENTS

| | | | |
|---|---|---|---|
| 3,741,575 | 6/1973 | Bortoli . | |
| 3,933,361 | 1/1976 | Beyl | 280/605 |
| 4,061,355 | 12/1977 | Korger | 280/605 |
| 4,173,354 | 11/1979 | Murata | 280/605 |

FOREIGN PATENT DOCUMENTS

| | | |
|---|---|---|
| 2118849 | 5/1970 | Fed. Rep. of Germany . |
| 7504420 | 6/1975 | Fed. Rep. of Germany . |
| 2517861 | 11/1976 | Fed. Rep. of Germany . |
| 2526909 | 12/1976 | Fed. Rep. of Germany . |

*Primary Examiner*—Joseph F. Peters, Jr.
*Assistant Examiner*—Milton L. Smith
*Attorney, Agent, or Firm*—Fleit & Jacobson

[57] ABSTRACT

A ski brake has two pivotable prongs, one on each side of the ski and having coaxial pivot shafts which are mounted on the ski to extend across the ski adjacent the upper ski surface and are each integral with an actuating arm depressible by a ski boot against spring action whereby to turn the pivot shafts and swing the brake prongs to an inoperative position. The spring action is exerted by way of a link member hinged to the ski by one end at a fixed position spaced lengthwise of the ski from the coaxial pivot shafts and connected by the other end to both actuating arms so as to be displaceable therealong when the actuating arms are depressed.

10 Claims, 4 Drawing Figures

SKI STOP

The invention relates to a ski stop in the form of a two-armed lever of which the pivot shaft extends transversely to the length of the ski on the upper surface thereof and one arm is divided to form two brake prongs disposed at both sides of the ski while the other arm is spring-loaded and can be engaged by the ski boot.

In such ski stops known for example from German Gebrauchsmuster 75 04 420 and German Auslegeschrift 21 18 849, the brake prongs are alone pivotably mounted to the side faces of the ski and there extended beyond their pivot shaft, said extensions, together with a rigid cross-bar which connects same and serves as a pedal, forming the arm of the lever that is engaged by the ski boot. The pedal is engaged by the one ends of two tension springs disposed near the outer edges of the ski, the other ends being secured to the ski beyond the pivot shaft of the ski stop as viewed from the pedal.

Such a spring arrangement and mounting of the brake prongs permits a relatively short height to be obtained for the ski stop in its inoperative position. However, the mounting of the brake prongs by means of extremely short shafts constitutes a decided point of weakness because these shafts are only permitted to project slightly beyond the ski so as to avoid with certainty interference between the two ski stops or their pivot axes by becoming hooked together during skiing. This extremely short mounting of the brake prongs is subjected to particularly heavy loading and possibly becomes overloaded when a ski released from the skier's boot slips off transversely to the line of fall of a slope and the entire supporting moment of the loaded brake prong has to be taken up by its bearing.

In addition, the arrangement of the forwardly directed brake prongs presents considerable danger in that the brake prong on the outside of the ski becomes ensnared in some obstacle that has not been seen by the skier or was invisible to him, which could result in an unexpected and therefore dangerous fall.

Mounting of this known ski stop turned through 180° so that the pedal points towards the front tip of the ski is in this case not possible because the long lever arm of the pedal required by the tension springs to achieve an adequately large extending force would then not permit rapid and uncomplicated stepping into the binding.

It is therefore the object of the present invention to provide a particularly robust ski stop of the stated kind with the arm of the lever that is engaged by the ski boot being as short as possible, the ski stop being adapted to be mounted with its brake prongs directed towards the rear end of the ski in the inoperative position, the ski stop also being adapted to permit uncomplicated stepping into the binding and at the same time providing a strong braking effect by means of steeply projecting brake prongs.

With a ski stop according to the one end of a coupling is mounted at a position fixed with respect to the ski at a spacing from the pivot shaft and the other end is connected to the lever arm engageable by the ski boot by way of a yoke which is parallel to the pivot shaft and displaceable lengthwise of the shorter of the two parts. The yoke is under the influence of at least one spring which biasses it towards a limiting position remote from the shaft.

The arrangement according to the invention permits extremely stable mounting of the brake prongs which, in turn, permits a correspondingly strong spring to be used to achieve a high erecting force for the ski stop.

A particularly compact construction of the ski stop according to the invention is achieved in that the spring is a compression spring guided on the arm engageable by the ski boot.

A preferred embodiment is achieved in that the coupling is formed by a U-shaped wire bracket of which the limbs each have an angled eye, the eyes forming the displaceable yoke.

In this case, converging of the limbs of the U-shaped supporting bracket towards the yoke when the lever arm engaged by the boot is in two parts has the advantage that, after mounting of the ski stop on the ski, the brake prongs come to lie against the side faces of the ski under the influence of the prestressed wire bracket during pivoting of the ski stop from its braking position to its inoperative position, this achieving automatic adaptation of the ski stop to different widths of ski.

In a further development of the invention, a pedal is mounted on a shaft parallel to the pivot shaft at the free end of the arm engaged by the ski boot, and is provided with a cover for the spring and the coupling. This minimizes soiling and icing up of the pivots and the spring of the ski stop.

To avoid locking or snagging of the ski boot sole and the arm of the ski stop engaged by the ski boot during stepping into the binding, another development of the invention provides for the pedal to be rotatable on the shaft.

In this case the pedal may comprise a cam which is spaced from its rotary shaft and can be engaged by the spring by way of the yoke. When stepping into the binding, the boot-engaging face of the pedal will then be disposed substantially parallel to the sole of the ski boot which makes stepping into the binding considerably simpler.

Two embodiments of the ski stop according to the invention will now be described with reference to the accompanying drawings, wherein.

Figure 2:
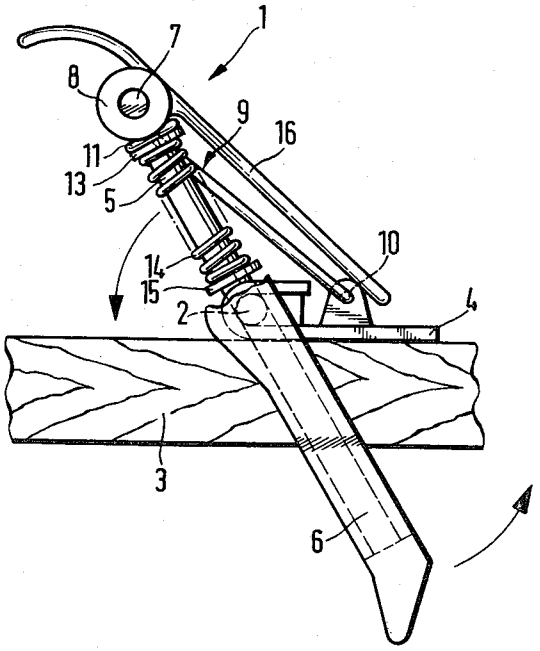
FIG. 2 is a side elevation of the ski stop in the same position.
Figure 1:
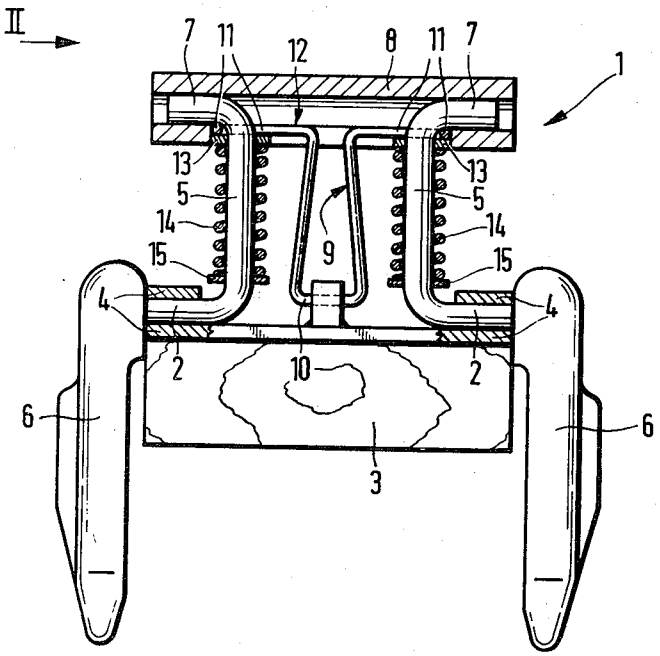
FIG. 1 is an elevation of a first embodiment of the ski stop in its braking position viewed from the end of the ski, the cover being omitted.

The two ski stops 1, 17 illustrated in FIGS. 1 to 4 have their respective pivot shafts 2 held on the surface of a ski 3, preferably in the heel region of the ski boot, by means of a bearing member 4. The bearing member 4 is secured to the ski 3 by means of screws (not shown).

The ski stop 1 according to the fist example (FIGS. 1 and 2) comprises in essence two mirror-image identical U-shaped wire brackets disposed symmetrically to the longitudinal axis of the ski, their webs 5 forming the first arm of the lever that is engageable by the ski boot and their limbs adjacent the ski forming the pivot shaft 2. These limbs project beyond the side faces of the ski and are there tightly secured to a respective brake prong 6, which both constitute the second arm of the lever. The free ends 7 of the other limbs of the U-shaped wire brackets serve as supports for a pedal 8.

Disposed between the two webs 5 of the wire brackets there is a coupling 9 which is formed into a U from wire, of which the web 10 is mounted at a fixed position with respect to the ski on the bearing member 4, of which the limbs converge towards the pedal 9, and the free ends are angled outwardly and each comprises an eye 11 which embraces the respective web 5 of the wire bracket. The angled eyes 11 together form a yoke 12 which is displaceable along the webs 5 and, with interposed washers 13, against the force of a helical compression spring 14 guided on each of the webs 5. At the ends of the webs 5 adjacent the ski, the springs 14 are again supported on a respective washer 15, while the limbs 7 of the wire bracket form the abutment for the yoke 12.

A flexible cover 16 which is shown only in FIG. 2 and is fixed to the pedal 8 protects the spring and coupling mechanism from soiling, icing up and mechanical damage.

When stepping into the binding, the ski boot engages the pedal 8 and thereby swings the ski stop in the direction of the arrow (see FIG. 2) out of its braking position to its inoperative position. The coupling thereby stresses the springs 14 with the aid of the yoke 12 so that, when the ski boot is deliberately or accidentally removed from the ski 3, the ski stop 1 will automatically assume its braking position.

The converging limbs of the coupling 9 pull the webs 5 of the wire bracket together so that the brake prongs 6 will always lie against the side faces of the ski.

Figure 4:
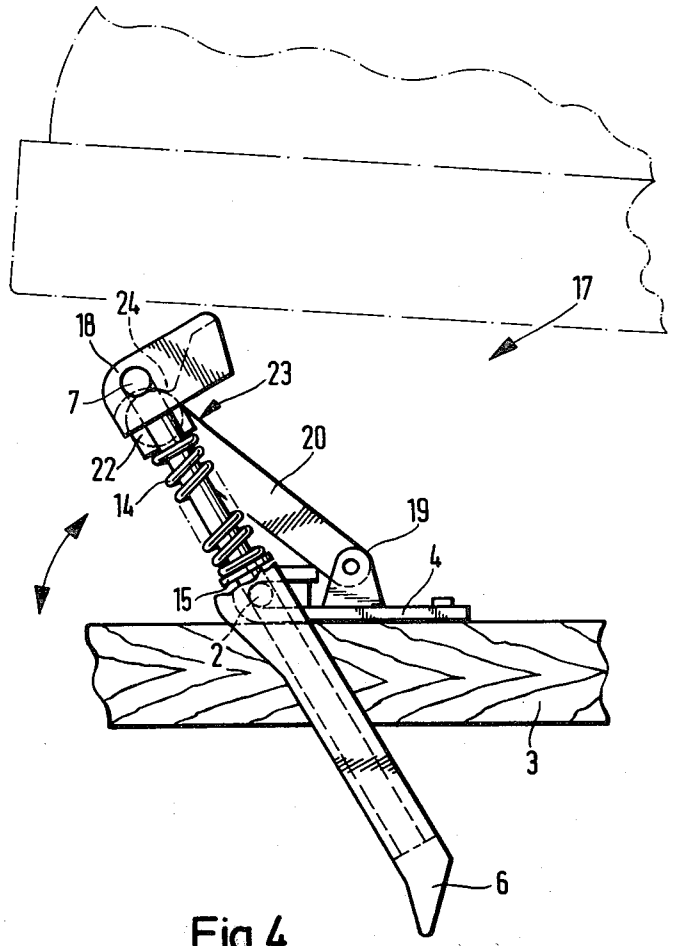
FIG. 4 is a view corresponding to FIG. 2 of the second example and, in chain-dotted lines, part of the sole of the ski boot just before pivoting of the ski stop during stepping into the binding.
Figure 3:
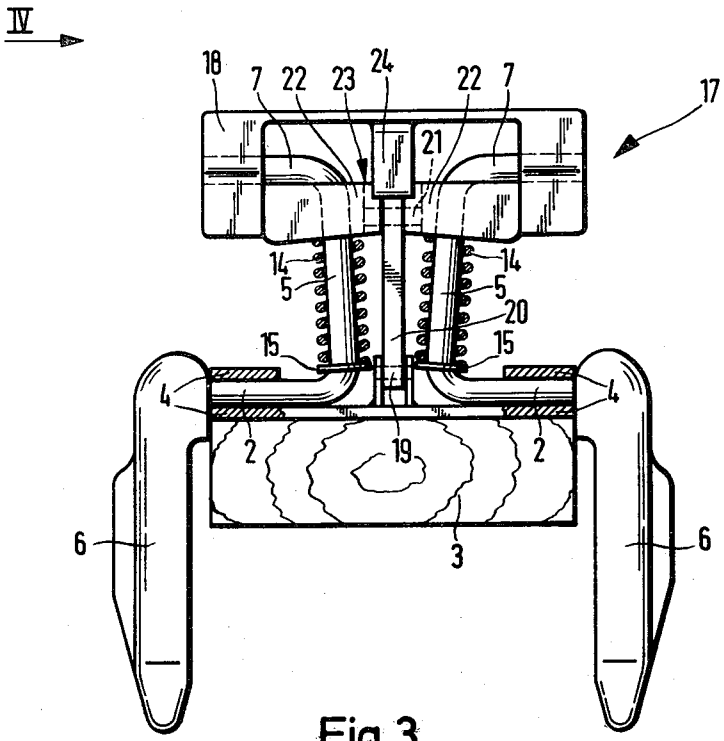
FIG. 3 is an elevation similar to FIG. 1 of a second example of the ski stop.

In the case of the ski stop 17 according to the second example of FIGS. 3 and 4, the two mirror-image identical U-shaped wire brackets disposed symmetrically to the longitudinal axis of the ski, as well as the pivot shafts 2, the brake prongs 6, webs 5, helical compression springs 14 and washers 15 are identical with those of the first example. In contrast, in this embodiment the free ends 7 of the limbs of the U-shaped wire brackets opposite the pivot shafts 2 serve as bearing pins for a pedal 18.

A coupling 20 which is likewise disposed between the two webs 5 and mounted on the one hand on the bearing member 4 at a position 19 fixed with respect to the ski on the other hand receives a bearing pin 21 of which the ends are supported against axial displacement in the web of a respective U-member 22. The limbs of the U-members 22 embrace the webs 5 so that a yoke 23 formed by the U-members 22 and the bearing pins 21 is displaceable along the webs 5 in a manner similar to the first example against the force of helical compression springs 14 guided on the webs 5. Here, too, the springs 14 are supported by a respective washer 15 at the end of the webs 5 adjacent the ski, while the limbs 7 themselves form the abutment for the yoke 23.

A cam 24 provided on the pedal 18 in a central position as viewed in FIG. 3 abuts the end of the coupling 20 adjacent the yoke at a spacing from the pivot shaft 7 of the pedal 18. By means of a special shape for the cam 24, the pedal 18 of large area will be eccentrically impinged by the spring 14 by way of the coupling 20 at all times during stepping in, so that, during pivoting of the ski stop 17 in or against the direction of the arrow in FIG. 4 (e.g. when deliberately stepping out of the binding), the boot-engaging face of the pedal will fully abut the surface of the sole and slide along same during pivoting of the boot so that there will be no mutual blocking that could occur by snagging of the pedal in recesses of the sole.

What is claimed is:

1. A ski stop in the form of a two-armed lever having a extending transversely to the length of a ski on an upper surface thereof, one arm of said lever being divided to form two brake prongs disposed at both sides of the ski, the other arm being spring-loaded into a first position in which said prongs are in braking positions and being engageable by a ski boot for movement into a second position in which said prongs are in non-braking positions, a coupling (9, 10) having a first end mounted at a position fixed with respect to the ski at a spacing from the pivot shaft (2), and a second end connected to the other lever arm (5), yoke means (12, 23) for intercoupling the second end of the coupling and the other lever arm, the yoke means extending parallel to the pivot shaft and being displaceable lengthwise of the shorter of the other lever arm and the coupling (5; 9, 20), and spring biassing means for spring loading said other arm and for biassing the yoke means (12, 23) towards a limiting position remote from the pivot shaft.

2. A ski stop according to claim 1, characterised in that the spring biassing means comprises compression spring guided on the other arm (5) engageable by the ski boot.

3. A ski stop according to claim 1 or claim 2, characterised in that the coupling (9) is formed by a U-shaped wire bracket having limbs, each limb having an angled eye (11) extending outwardly, the eyes forming the displaceable yoke means (12).

4. A ski stop according to claim 3, characterised in that the limbs of the U-shaped wie bracket converge towards the yoke means.

5. A ski stop according to claim 1, characterised in that, at a free end of the other arm engaged by the ski boot, a pedal is mounted parallel to the pivot shaft (2) and in that a cover (16) is provided for the spring biassing means and the coupling (9).

6. A ski stop according to claim 5, characterised in that the pedal is rotatable about an axis defined by free ends of the other arm.

7. A ski stop according to claim 6, characterised in that the pedal comprisses a cam (24) which is spaced from its rotary axis, said pedal being engaged by the spring biassing means by way of the yoke means (23).

8. A ski stop comprising two-armed lever means having first lever arm means, second lever arm means, and pivot shaft means for interconnecting said first and said second lever arm means, said pivot shaft means being mountable on an upper surface of a ski for pivotal movement about an axis extending transversely to the length of the ski, said first lever arm means being divided for forming brake prongs disposed on both sides of the ski; biassing means for urging said second lever arm means into a position in which said brake prongs are in braking positions, said second lever arm means being engageable by a ski boot for moving said brake prongs into non-braking positions; coupling means having a first end mountable on the upper surface of the ski at a fixed position spaced from said pivot shaft means; and yoke means for operatively associating a second end of said coupling means with said second lever arm means, said yoke means extending parallel to said pivot shaft means and being displaceable lengthwise with respect to the shorter of said coupling means and said second lever arm means, said biassing means being positioned to bias said yoke means into a limiting position remote from said pivot shaft means.

9. A ski stop comprising:

bearing member means (4) mounted on an upper surface of a ski for defining a pivot axis extending transversely to the length of the ski;

a pair of U-shaped wire brackets having webs (5) positioned between first end portions (2) and second end portions (7), the first end portions forming pivot shafts held by said bearing member for movement about the pivot axis such that said wire brackets are symmetric about a longitudinal axis of the ski, with said second end portions parallel to said pivot axis and ends of the first end portions extending outwardly from the longitudinal axis of the ski;

brake prongs (6) connected to ends of said first end portions disposed at both sides of the ski;

a pedal pivotally carried by said second end portions;

a U-shaped coupling (9) having a central web (10) pivotally connected to said bearing member means at a position spaced from the pivot axis, and having limbs extending between the web and outwardly extending eyes (11), the webs (5) passing through the eyes; and compression springs (14) guided on the webs (5) for urging the eyes (11) away from the pivot axis to thereby move the wire brackets into positions in which the brake prongs are in braking positions, the pedal being engageable by a ski boot to compress the springs and move the brake prongs into non-braking positions.

10. A ski stop comprising:

bearing member means (4) mounted on an upper surface of a ski for defining a pivot axis extending transversely to the length of the ski;

a pair of U-shaped wire brakets having webs (5) positioned between first end portions (2) and second end portions (7), the first end portions forming pivot shafts held by said bearing member for movement about the pivot axis such that said wire brackets are symmetric about a longitudinal axis of the ski, with said second end portions parallel to said pivot axis and ends of the first end portions extending outwardly from the longitudinal axis of the ski;

brake prongs (6) connected to ends of said first end portions disposed at both sides of the ski;

a pedal pivotally carried by said second end portions;

a coupling (20) having a first end portion pivotally connected to said bearing member means at a position spaced from the pivot axis;

a bearing pin (21) carried by a second end portion of said coupling;

shaped members carried by ends of said bearing pin and cooperating with said bearing pin to form a yoke (23) displaceable along the webs of said wire brackets; and compression springs (14) guided on the webs (5) for urging the yoke (23) away from the pivot axis to thereby move the wire brackets into positions in which the brake prongs are in braking positions, the pedal being engageable by a ski boot to compress the springs and move the brake prongs into non-braking positions.

* * * * *

UNITED STATES PATENT AND TRADEMARK OFFICE

CERTIFICATE OF CORRECTION

PATENT NO. : 4,294,458

DATED : October 13, 1981

INVENTOR(S) : Gerhard Sedlmair

It is certified that error appears in the above—identified patent and that said Letters Patent is hereby corrected as shown below:

On the title page

[75] Inventor: Gerhard Sedlmair, Farchant, Fed. Rep. of Germany

Signed and Sealed this

Second Day of March 1982

[SEAL]

Attest:

GERALD J. MOSSINGHOFF

Attesting Officer

Commissioner of Patents and Trademarks